United States Patent [19]

Friedenthal

[11] 4,261,576

[45] Apr. 14, 1981

[54] BACKGAMMON SET WITH FOLDING PARTS FOR RETRACTION AND EXTENSION

[76] Inventor: Robert Friedenthal, 49 Phelps St., Marlboro, Mass. 01752

[21] Appl. No.: 30,106

[22] Filed: Apr. 16, 1979

[51] Int. Cl.[3] ..... A63F 3/00

[52] U.S. Cl. ..... 273/285; 206/579

[58] Field of Search ..... 273/285, 286, 287, 283, 273/248; 206/579

[56] References Cited

U.S. PATENT DOCUMENTS

| | | | |
|---|---|---|---|
| 2,221,267 | 11/1940 | Robertson | 273/285 |
| 2,722,425 | 11/1955 | Gazelle | 273/285 X |
| 3,458,216 | 7/1969 | Harrison | 273/287 X |
| 3,836,418 | 9/1974 | Montgomery | 273/285 X |

FOREIGN PATENT DOCUMENTS

| | | | |
|---|---|---|---|
| 503955 | 4/1939 | United Kingdom | 273/287 |

*Primary Examiner*—Richard C. Pinkham
*Assistant Examiner*—Scott L. Brown
*Attorney, Agent, or Firm*—Morse, Altman, Oates & Dacey

[57] ABSTRACT

The board of a backgammon set is characterized by a central box portion and oppositely deployed festoon portions. The box portion serves as the bar during play and as a container during storage. The festoon portions are extended as tables during play and retracted into the box portion during storage, with the playing pieces.

8 Claims, 6 Drawing Figures

BACKGAMMON SET WITH FOLDING PARTS FOR RETRACTION AND EXTENSION

BACKGROUND OF THE INVENTION

1. Field of the Invention

The present invention relates to portable board games and, more particularly, to portable board games that are convertible between a playing condition, in which the board lies flat for manual and visual access by the players, and a portable condition, in which the board folds into a container for the game's playing pieces.

2. The Prior Art

Typically, portable backgammon games have been characterized by a playing board having two rigid halves which lie flat in the same plane during play and which fold together to form an attache-case-like container during storge. Such structures, despite their portability, are inconveniently large. Since many backgammon players customarily carry their backgammon games for use during recreational moments at almost any time, it is desired to reduce the bulk of the gam when not in play. Very small boards, although easy to carry, are difficult to use visually and manually. There has been a long felt need for a board of ordinary size that is capable of being folded into a very small total bulk.

BRIEF SUMMARY OF THE INVENTION

The primary object of the present invention is to provide a backgammon set of particular construction with a board having a central box portion and oppositely deployed festoon portions. The box portion serves as the bar during play and as a container during storage. The festoon portions are extended as tables during play and retracted into the box portion during storage with the men, dice, and doubling cube. Preferably, the box portion and the festoon portions are bifurcated in such a way that each box portion half is capable of storing festoon portion halves extending therefrom; and the box portion halves, when containing the playing pieces of the game, are capable of being folded together for extreme compactness.

Other objects of the present invention will in part be obvious and will in part appear hereinafter.

The invention accordingly comprises the backgammon game of the present disclosure, together with its parts and their interrelationships, the scope of which will be indicated in the appended claims.

BRIEF DESCRIPTION OF THE DRAWINGS

For a fuller understanding of the nature and objects of the present invention, reference is made to the following detailed description, which is to be taken in connection with the accompanying drawings wherein.

DETAILED DESCRIPTION OF THE PREFERRED EMBODIMENT

Figure 1:
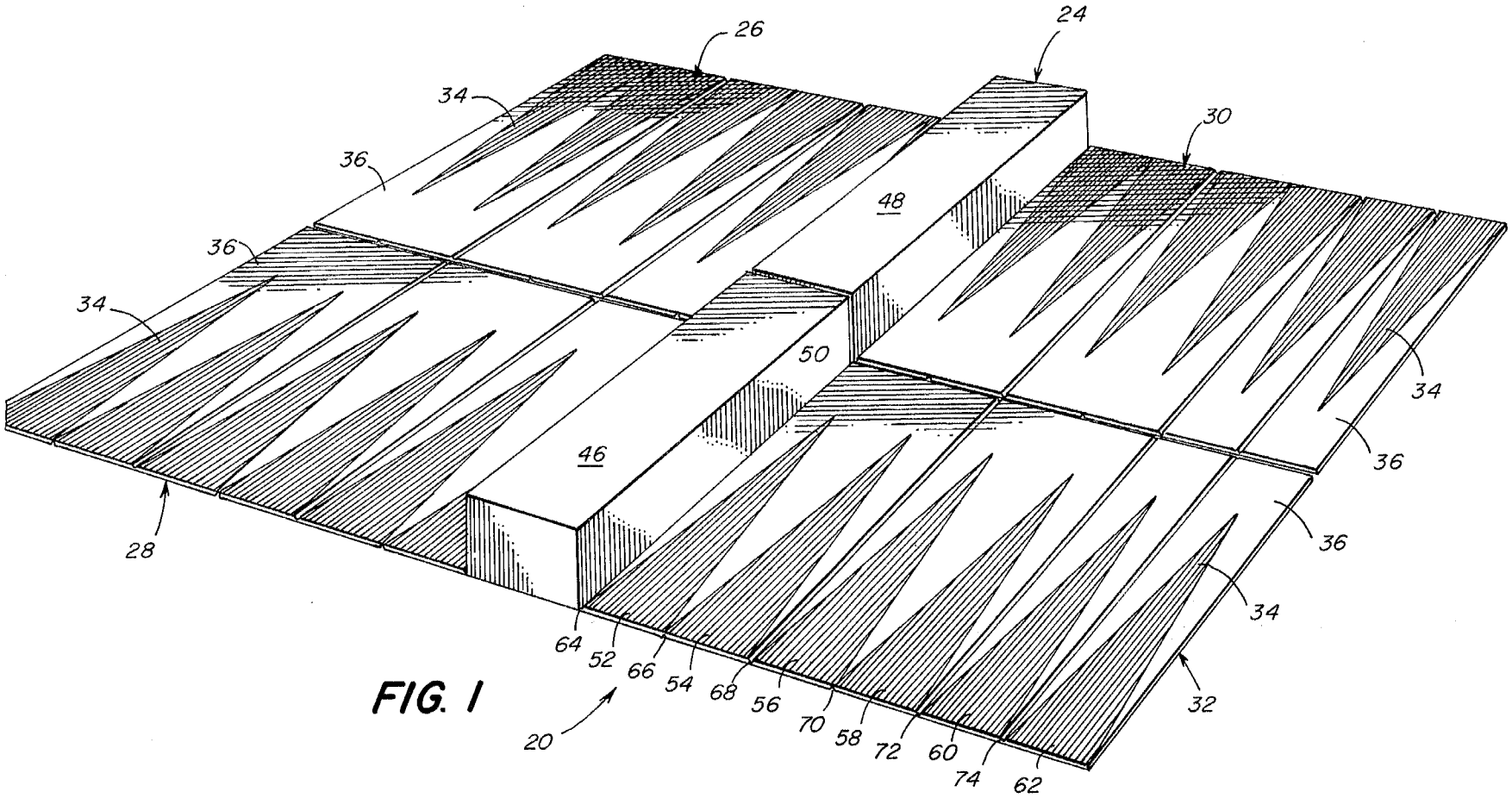
FIG. 1 is a perspective view of a backgammon board of the present invention, illustrating the relationship between box portion and festoon portions, when in playing condition.

Generally the illustrated backgammon game comprises a gameboard 20 and playing pieces 22. Gameboard 20 includes a medial bar 24 and four tables 26, 28, 30, 32, each marked with wedges or points 34, having a color or other visual characteristic that contrasts with the background color 36 of its table. Playing pieces 22 include fifteen black or dark men 38, fifteen white or light stones 40, four dice 42, and a doubling cube 44.

Figure 3:
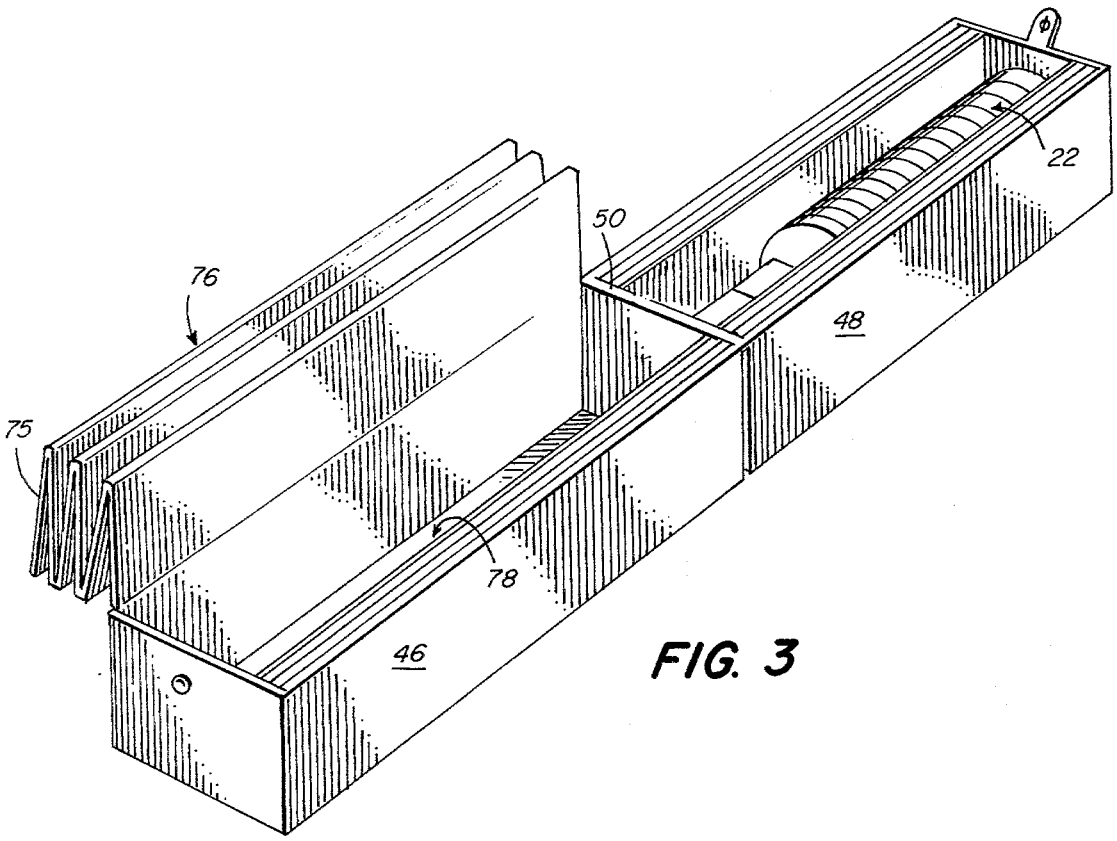
FIG. 3 is a perspective view of the backgammon set of FIG. 1, partially retracted for storage.
Figure 5:
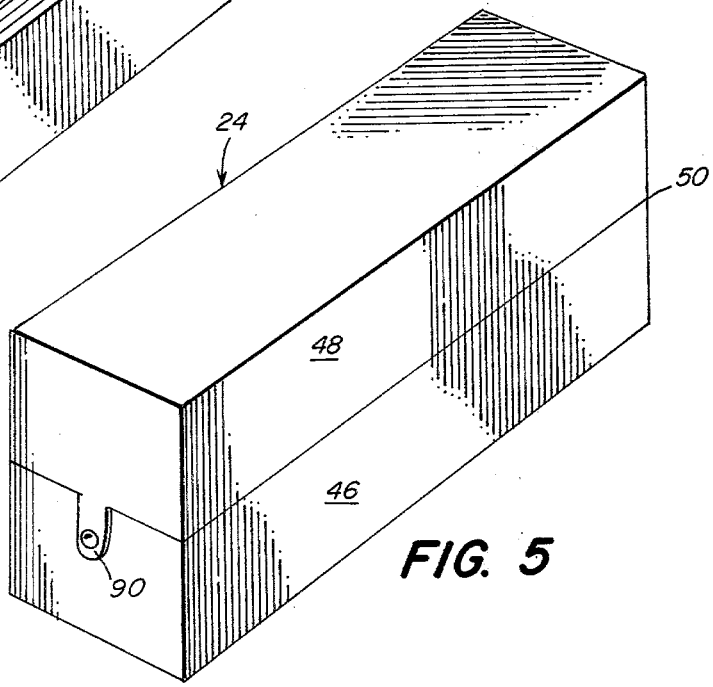
FIG. 5 is a perspective view of the backgammon set of FIG. 1, fully retracted for storage.

As shown, box portion 24 includes two receptacle portions 46, 48, which are pivotally connected to each other by a hinge 50. Receptacle portions 46, 48 are movable about hinge 50 between an open position, as shown in FIG. 3, and a closed position, as shown in FIG. 5. Each of Tables 26, 28, 30, 32 includes a group of six festoon portions 52, 54, 56, 58, 60, 62, which are separated from a longitudinal edge of one of receptacle portions 46, 48 and from eachother by hinges 64, 66, 68, 70, 72, 74. The festoon portions of each group are movable about their hinges between an open position at which they constitute a table and a closed position at which they are contained within their adjoining receptacle portions.

Figure 4:
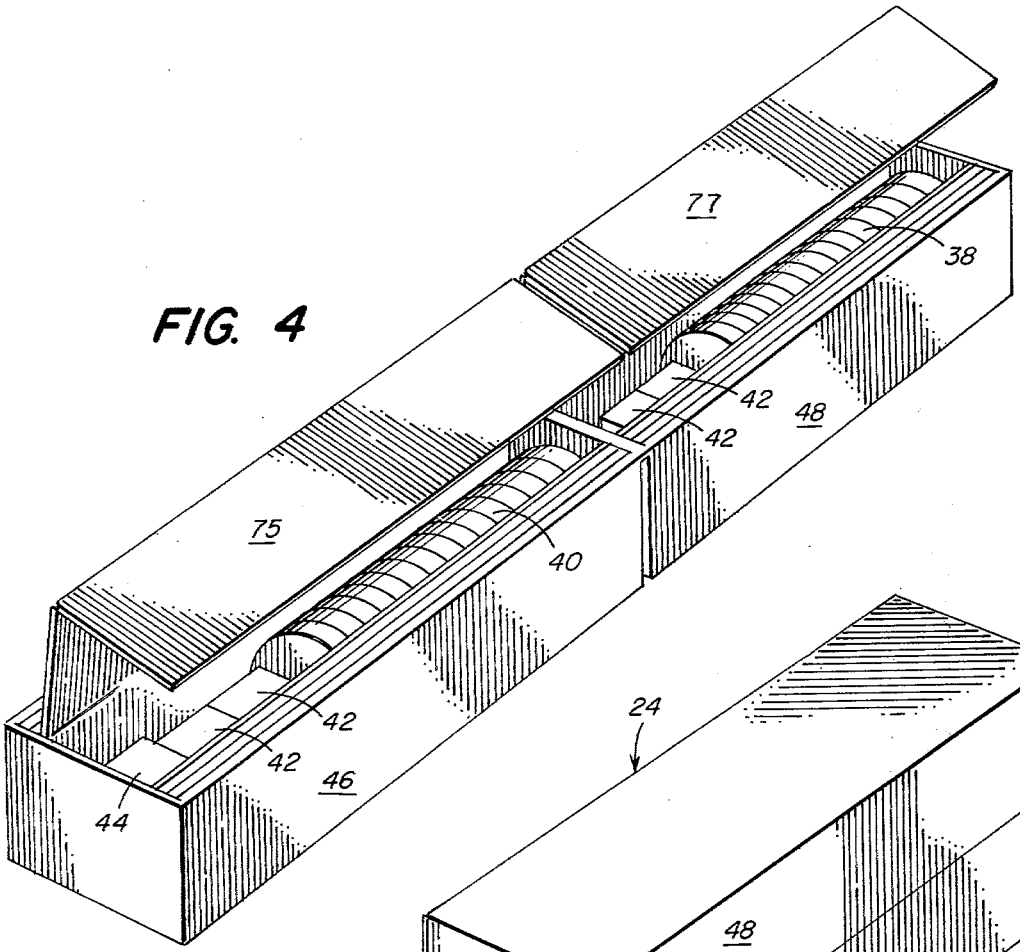
FIG. 4 is another perspective view of the backgammon set of FIG. 1, more retracted for storage.

The width of each festoon portion is such that the outer edges of a group of folded festoon portions, as shown at 76, is capable of clearing an associated group of folded festoon portions, stored within the receptacle portion, as shown at 78. The widths and lengths of receptacle portions 46, 48 and the sizes of the playing pieces, including a total of thirty men 38, 40, four dice 42, and doubling cube 44, are such that the playing pieces fit between folded and stored groups of festoon portions in the receptacle portions, and such that, under these conditions, the receptacle portions can be folded together to provide the closed compartment shown in FIG. 5. As shown in FIG. 4, the outer festoon 75 of each group of festoons 76 can be folded over the open compartment to serve as a lid for retaining the pieces in place when the box portion is being closed. Preferably, the dimensions of each receptacle portion is approximately 5.29 inches long$\times$1.09 inches deep$\times$1.53 inches wide. Preferably the walls of the receptacle portions and the festoon portions are approximately 0.1 inch thick.

Figure 2:
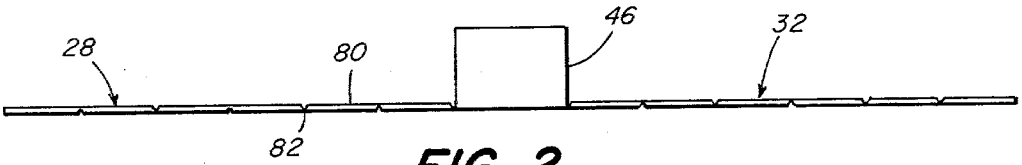
FIG. 2 is a cross-sectional view of the backgammon board of FIG. 1.

In the embodiment of FIGS. 1 to 5, the receptacle portions and the festoon portions are composed integrally of a cast polymer, preferably an olefin such as polypropylene, the different elements being connected by integral hinges. The casting is such that the various elements are composed of relatively thick polymer sections, as shown at 80 in FIG. 2, and the various hinges are composed of relatively thin polymer sections, as shown at 82 in FIG. 2. As shown in FIG. 2, the thin polymer sections alternately connect the edges of opposite faces of the thick polymer sections in order to permit ease of folding. The casting is effected with the tables fully extended so that the natural or unflexed condition or "memory" of the hinges tends to maintain the tables flat when they are fully extended.

Figure 6:
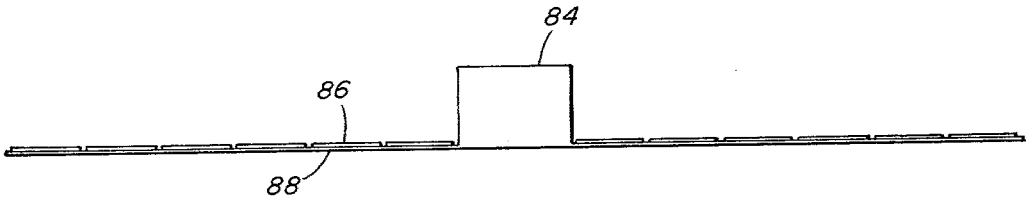
FIG. 6 is a cross-sectional view of an alternative embodiment of the backgammon board of FIG. 1.

In another embodiment, as shown in FIG. 6, the receptacle portions 84 and festoon portions 86 are composed of a rigid solid, such as plastic or metal, and the hinges are constituted by a flexible fabric 88, to which the receptacle portions and festoon portions are bonded by a suitable adhesive.

OPERATION

In operation, the backgammon game of the present invention is locked in the closed condition shown in FIG. 5, by a clasp 90. When the clasp is opened, the receptacle portions are opened, the pieces are removed, the tables are extended, and the entire board is inverted for play, as shown in FIG. 1. For storage, these steps are reversed.

It will be understood that in alternative embodiments somewhat fewer or more of the elements are hinged to eachother in order to achieve different storage objectives. In alternative embodiments, the festoons fold into groups that abut against the external walls of the receptacle portions. Since certain changes may be made in the present disclosure without departing from the scope of the invention herein, it is intended that all matter described in the foregoing specification or shown in the accompanying drawings be interpreted in an illustrative and not in a limiting sense.

What is claimed is:

1. A backgammon game comprising:

(a) box portion and table portion;

(b) said box portion defining a bar for use during play and a compartment for use during storage;

(c) said table portion including hinged festoon portions for deployment outwardly from said bar during play and retraction into said compartment during storage, said festoon portions having visual wedges thereon and including at least a pair of opposed groups of festoons, one of said groups of festoons clearing the other of said groups of festoons when said other of said groups of festoons is in said compartment; and (d) playing pieces for movement in reference to said table means during play and for enclosure in said compartment means during storage.

2. The backgammon game of claim 1, wherein said box portion includes two receptacle portions that are hinged together.

3. A backgammon game comprising:

(a) a box portion and a table portion;

(b) said box portion defining a medial bar for use during play and a hollow compartment for use during storage;

(c) said table portion including festoon portions for deployment outwardly from said medial bar during play and retraction into said hollow compartment during storage, said festoon portions having visual indicia thereon;

(d) playing pieces for movement in reference to said table portion during play and for enclosure in said hollow compartment during storage; and (e) a hinge connecting said box portion and said festoon portions.

4. The backagammon game of claim 3, wherein said box portion and said festoon portions are composed of a relatively rigid material and said hinge is composed of a relatively flexible material.

5. A backgammon game comprising:

(a) a first receptacle and a second receptacle, both having longitudinal free edges, transverse free edges, and closed bottoms;

(b) a pair of first tables extending oppositely from said longitudinal free edges of said first receptacle;

(c) a pair of second tables extending oppositely from said longitudinal free edges of said second receptacle;

(d) each of said pair of first tables including a plurality of festoons with longitudinal edges and transverse edges;

(e) each of said pair of second tables including a plurality of festoons with longitudinal edges and transverse edges;

(f) a hinge connecting a free transverse edge of said first receptacle and a free transverse edge of said second receptacle;

(g) hinges connecting said longitudinal edges of said first receptacle and said longitudinal edges of said plurality of festoons of said pair of first tables; and (h) hinges connecting said longitudinal edges of said second receptacle and said longitudinal edges of said plurality of festoons of said pair of second tables.

6. The backgammon game of claim 5 wherein said first receptacle, said second receptacle, said first pair of tables, said second pair of tables, and said hinges are composed of integral polymer.

7. The backgammon game of claim 6 wherein the unflexed condition of said hinges exists when said tables are extended and lying flat.

8. A backgammon game comprising:

(a) a first receptacle and a second receptacle, both having longitudinal free edges, transverse free edges, and closed bottoms;

(b) a pair of first tables extending oppositely from said longitudinal free edges of said first receptacle;

(c) a pair of second tables extending oppositely from said longitudinal free edges of said second receptacle;

(d) each of said pair of first tables including a plurality of festoons with longitudinal edges and transverse edges;

(e) each of said pair of second tables including a plurality of festoons with longitudinal edges and transverse edges;

(h) a hinge connectng a free transverse edge of said first receptacle and a free transverse edge of said second receptacle;

(g) hinges connecting said longitudinal edges of said first receptacle and said longitudinal edges of said plurality of festoons of said pair of first tables;

(h) hinges connecting said longitudinal edges of said second receptacle and said longitudinal edges of said plurality of festoons of said pair of second tables;

(i) said free edges of said first receptacle and said free edges of said second receptacle are registrable with each other to define a compartment containing said groups of festoons in retracted condition.

* * * * *